US008408754B2

(12) United States Patent
Tsuchiya et al.

(10) Patent No.: US 8,408,754 B2
(45) Date of Patent: Apr. 2, 2013

(54) VARIABLE ILLUMINATION APPARATUS

(75) Inventors: Miki Tsuchiya, Kanagawa (JP); Hiroaki Ishiguro, Aichi (JP)

(73) Assignee: Sony Corporation, Tokyo (JP)

( * ) Notice: Subject to any disclaimer, the term of this patent is extended or adjusted under 35 U.S.C. 154(b) by 412 days.

(21) Appl. No.: 12/868,170

(22) Filed: Aug. 25, 2010

(65) Prior Publication Data

US 2011/0051425 A1 Mar. 3, 2011

(30) Foreign Application Priority Data

Sep. 1, 2009 (JP) ..... P2009-201380

(51) Int. Cl.
*F21V 7/22* (2006.01)
*F21V 5/00* (2006.01)
*F21V 7/00* (2006.01)

(52) U.S. Cl. ..... 362/318; 362/331

(58) Field of Classification Search ..... 362/318, 362/331, 296.01, 311.01; 359/665–667, 359/811, 819, 822, 672–675; 349/13
See application file for complete search history.

(56) References Cited

U.S. PATENT DOCUMENTS 6,702,483 B2 * 3/2004 Tsuboi et al. ..... 396/449

FOREIGN PATENT DOCUMENTS

JP 2008-180919 8/2008

* cited by examiner

*Primary Examiner* — Anh Mai
*Assistant Examiner* — Elmito Breval
(74) *Attorney, Agent, or Firm* — K&L Gates LLP

(57) ABSTRACT

A variable illumination apparatus includes: a first substrate; a second substrate opposed to the first substrate with a predetermined gap therebetween; a surrounding wall that is disposed between the first and second substrates, has a first opening and a second opening opposed to each other, and has an inner side surface that is tapered toward the second opening from the first opening; a partition wall to partition a liquid chamber formed by the first substrate, the second substrate, and the surrounding wall into regions, the partition wall being vertical to the first substrate and the second substrate; a liquid lens having a lens surface that is formed at an interface between two liquids and is electrically deformable, the two liquids being accommodated in each of the regions and each having a different refractive index; and a light source to irradiate light to the liquid lens from the first opening side.

6 Claims, 9 Drawing Sheets

VARIABLE ILLUMINATION APPARATUS

CROSS REFERENCES TO RELATED APPLICATIONS

The present application claims priority to Japanese Priority Patent Application JP 2009-201380 filed in the Japan Patent Office on Sep. 1, 2009, the entire content of which is hereby incorporated by reference.

BACKGROUND

The present application relates to a variable illumination apparatus using an electrowetting phenomenon.

As variable illumination apparatuses that change an orientation of light to be emitted, there is a flash apparatus capable of irradiating a flash to a subject in a broad area by using an electrowetting phenomenon, for example (see, for example, Japanese Patent Application Laid-open No. 2008-180919 (paragraph [0023]); hereinafter, referred to as Patent Document 1). The flash apparatus includes a liquid lens device and a light source. The liquid lens device includes two liquids whose refractive indices are different from each other, and an interface (lens surface) between the two liquids changes its shape by control of an applied voltage. In such a flash apparatus, to realize the thinning thereof, it is conceivable that the liquid lens device is provided with a plurality of lens surfaces and a height of each of the lens surfaces is reduced to thus structure a thinner liquid lens device than that having a single lens surface.

SUMMARY

However, in the flash apparatus as described above, it has been difficult to obtain wide light orientation characteristics.

In view of the circumstances as described above, it is desirable to provide a variable illumination apparatus having wide light orientation characteristics while realizing the thinning of the apparatus, using an electrowetting phenomenon.

According to an embodiment, there is provided a variable illumination apparatus including a first substrate, a second substrate, a surrounding wall, a partition wall, at least one liquid lens, and a light source. The second substrate is opposed to the first substrate with a predetermined gap therebetween. The surrounding wall is disposed between the first substrate and the second substrate, has a first opening and a second opening that are opposed to each other, and has an inner side surface that is tapered such that an opening area is enlarged toward the second opening from the first opening. The partition wall partitions a liquid chamber formed by being surrounded by the first substrate, the second substrate, and the surrounding wall into a plurality of regions, the partition wall being vertical to the first substrate and the second substrate. The at least one liquid lens has a lens surface that is formed at an interface between two liquids and is electrically deformable, the two liquids being accommodated in each of the plurality of regions and each having a different refractive index. The light source irradiates light to the at least one liquid lens from the first opening side.

With this structure, since the surrounding wall is tapered such that the opening area is enlarged along a traveling direction of the light emitted from the light source, an optical axis of the lens surface of the liquid lens is positioned so as to extend outwardly and obliquely with respect to an optical axis of the light source. As a result, the variable illumination apparatus has light orientation characteristics with a wide light emission range, as compared to a variable illumination apparatus in which the surrounding wall is not tapered. Further, by providing a plurality of lens surfaces, the variable illumination apparatus can be made thinner than that having a single lens surface.

Each of the light source and the at least one liquid lens may have a linear shape, a longitudinal direction of the light source and that of the at least one liquid lens being parallel to each other. In a case where the linear light source is used as described above, it is desirable that a lens surface be also made linear.

The variable illumination apparatus may further include: a reflector plate to accommodate the light source, and reflect light emitted from the light source and cause the light to enter the liquid lenses as parallel light; and a cylindrical lens that is disposed between the light source and the liquid lenses at a position corresponding to a gap between the adjacent liquid lenses, and emits, as parallel light, the light emitted from the light source but excluding light parallel to the parallel light.

With this structure, by providing the cylindrical lens, out of the light emitted from the light source, light that is not reflected by the reflector plate and is not parallel to the parallel light can be obtained as parallel light. Accordingly, an amount of light in the vicinity of the optical axis of the light source can be increased more than that obtained in a case where the optical member is not provided, and the light that passes through the liquid lens can be imparted with desired light orientation characteristics.

The at least one liquid lens may include two liquid lenses, the number of light source provided may be one, and the light source may be disposed at a position corresponding to the interface between the two liquid lenses. In a case where two liquid lenses and one light source are provided as described above, the two liquid lenses and one light source can be disposed such that an optical axis of the light emitted from the light source is positioned at an interface between two lens surfaces, and a cylindrical lens can be additionally disposed at a position corresponding to the interface between the two lens surfaces. As a result, even with one light source, it is possible to impart light orientation characteristics to the light that passes through the liquid lenses, the light orientation characteristics being equal to those obtained when two light sources are disposed so as to correspond to the two respective lens surfaces.

The variable illumination apparatus may further include an optical member that is disposed between the light source and the liquid lenses and converts an optical axis of the light that enters the liquid lenses so that the optical axis extends outwardly and obliquely with respect to an optical axis of the light emitted from the light source.

With this structure, since the optical member is provided, a variable illumination apparatus having light orientation characteristics with a wider light emission range can be obtained.

According to anther embodiment, there is provided a variable illumination apparatus including a first substrate, a second substrate, a third substrate, a liquid lens, a light source, and an optical member. The second substrate is opposed to the first substrate with a predetermined gap therebetween. The third substrate is disposed between the first substrate and the second substrate to form a liquid chamber. The liquid lens has a plurality of lens surfaces that are formed at an interface between two liquids and are electrically deformable, the two liquids being accommodated in the liquid chamber and each having a different refractive index. The light source irradiates light to the liquid lens. The optical member is disposed between the light source and the liquid lens and converts an optical axis of light that enters the liquid lens so that the optical axis extends outwardly and obliquely with respect to an optical axis of light emitted from the light source.

With this structure, since the optical member is provided, a variable illumination apparatus having light orientation characteristics with a wider light emission range than a variable illumination apparatus including no optical member can be obtained.

As described above, according to the embodiments of the present application, a variable illumination apparatus capable of obtaining wide light orientation characteristics can be provided.

These and other objects, features and advantages of the present application will become more apparent in light of the following detailed description of best mode embodiments thereof, as illustrated in the accompanying drawings.

Additional features and advantages are described herein, and will be apparent from the following Detailed Description and the figures.

DETAILED DESCRIPTION

Figure 1:
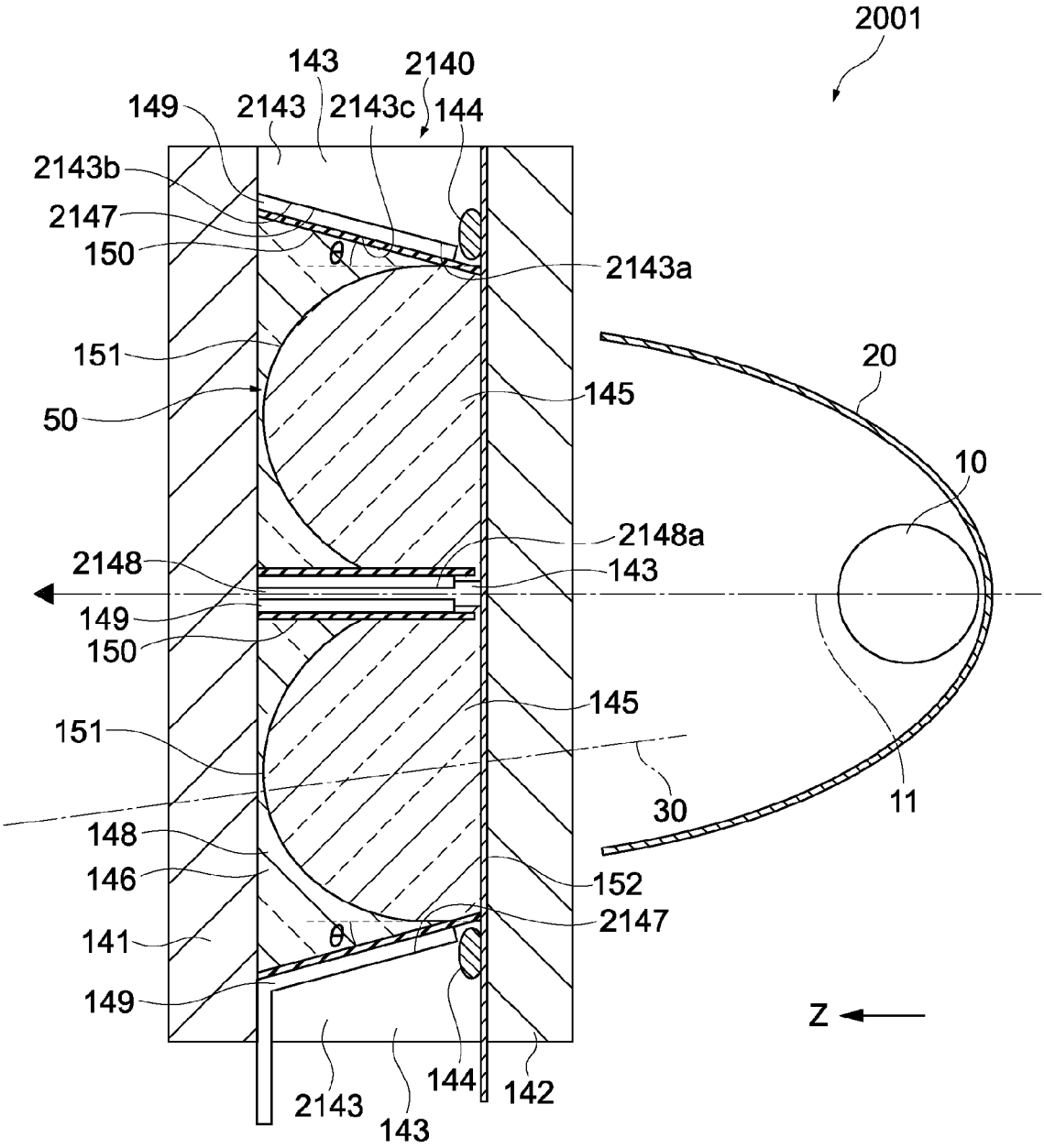
FIG. 1 is a schematic cross-sectional diagram of a flash apparatus according to a first embodiment.
Figure 2:
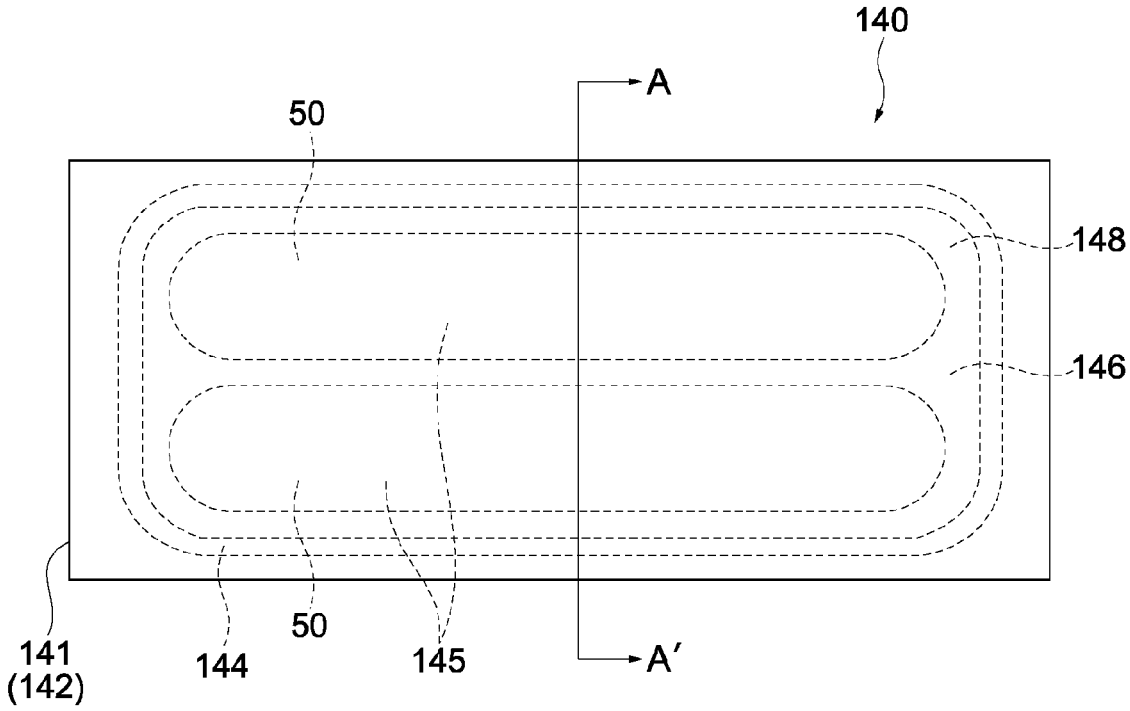
FIG. 2 is a schematic plan view of a liquid lens device constituting the flash apparatus of FIG. 1.

The present application is described below in detail with reference to the drawings according to an embodiment. The detailed description is provided as follows:

FIG. 1 is a schematic cross-sectional diagram of a flash apparatus as a variable illumination apparatus according to this embodiment. FIG. 2 is a schematic plan view of a liquid lens device constituting the flash apparatus.

As shown in FIGS. 1 and 2, a flash apparatus 2001 using an electrowetting phenomenon includes a light source 10, a reflector 20 as a reflector plate, and a liquid lens device 2140.

The light source 10 is a linear, cylindrical flash discharge tube (xenon tube) having a diameter of 1 to 2 mm. The xenon tube 10 is disposed so as to correspond to an interface between two adjacent lens surfaces 151 to be described later so that the interface between the two lens surfaces 151 is positioned on an optical axis 11 of light emitted from the xenon tube 10 to the liquid lens device 2140 (parallel to z axis).

The reflector 20 accommodates the xenon tube 10, and reflects and narrows the light emitted from the xenon tube 10 to have parallel light, thus irradiating the parallel light to the liquid lens device 2140. The linear reflector 20 has a cross section of a semi-elliptical arc shape or a parabolic shape, and is disposed such that the light emitted from the xenon tube 10 is narrowed, for example, the xenon tube 10 is positioned at a focal point of the parabola. The reflector 20 is constituted of a member having a high reflectance, such as aluminum. The reflector 20 reflects the light emitted from the xenon tube 10 and emits the light, as parallel light, to the liquid lens device 2140.

The liquid lens device 2140 includes a first substrate 141, a second substrate 142, a cavity substrate 143 as a third substrate, and a sealing member 144. In a space defined by the above members in the liquid lens device 2140, a liquid lens 50 constituted of a first liquid 145 and a second liquid 146 is accommodated. The first substrate 141 and the second substrate 142 are opposed to each other with a predetermined gap therebetween. The cavity substrate 143 is disposed between the first substrate 141 and the second substrate 142.

The liquid lens device 2140 is obtained by laminating the first substrate 141, the cavity substrate 143, and the second substrate 142 in the stated order. A space defined by a through-hole 2147 formed on the cavity substrate 143, the first substrate 141, and the second substrate 142 is to be a liquid chamber 148. The liquid lens 50 constituted of the first liquid 145 and the second liquid 146 is accommodated in the liquid chamber 148. The sealing member 144 has a planar shape like a ring and is disposed at a position capable of sealing in the first liquid 145 and the second liquid 146 in the liquid lens device 2140.

The cavity substrate 143 is constituted of a surrounding wall 2143 and a partition wall 2148. The surrounding wall 2143 has a frame shape including a first opening 2143*a* and a second opening 2143*b* that are opposed to each other, and has an inner side surface 2143*c* that is tapered such that an opening area is enlarged toward the second opening 2143*b* from the first opening 2143*a*. The taper has an angle θ of 5 to 10 degrees with respect to a plane that is vertical to the second substrate 142. The partition wall 2148 partitions the liquid chamber 148 surrounded by the surrounding wall 2143 into a plurality of regions, e.g., two regions in this embodiment. The partition wall 2148 is disposed to be vertical to the first substrate 141 and the second substrate 142, with the result that two through-holes 2147 are formed. A side surface 2148*a* of the partition wall 2148 is not tapered and is vertical to the first substrate 141 and the second substrate 142. Further, the partition wall 2148 is disposed along the optical axis 11 of the light source 10 (parallel to z axis). The cavity substrate 143 is formed of a material such as a synthetic resin, metal, glass, and ceramics. A first electrode 149 is formed on a surface of the cavity substrate 143 on the liquid chamber 148 side, and an insulation layer 150 is formed on an upper surface of the first electrode 149. The first electrode 149 is connected to an external power source (not shown).

The xenon tube 10 is disposed on the first opening 2143*a* side of the liquid lens device 2140.

The liquid lens device 2140 according to this embodiment is structured such that optical characteristics due to the electrowetting phenomenon can be expressed. It should be noted that the structure of the liquid lens device 2140 is not limited to that described below.

The first substrate 141 and the second substrate 142 form the liquid chamber 148 and also serve as a path of light that enters the liquid lens device 2140 or is emitted from the liquid lens device 2140. The first substrate 141 and the second substrate 142 are formed of a material of high transparency, such as glass and an acrylic resin, with the result that an intensity loss of the incident light or emitted light can be reduced. A second electrode 152 that comes into contact with the first liquid 145 is formed on a surface of the second substrate 142 on the liquid chamber 148 side, and is connected to an external power source (not shown).

The sealing member 144 is disposed between the cavity substrate 143 and the second substrate 142. The sealing member 144 may be disposed at a circumferential portion of the through-hole 2147 of the cavity substrate 143 or in a sealing member groove formed independently from the through-hole 2147. The sealing member 144 is formed of a material such as an elastomer, metal, and a synthetic resin such that the first liquid 145 and the second liquid 146 can be sealed in. A cross section of the sealing member 144 is circular, V-shaped, or rectangular, which can be selected as appropriate.

The first electrode 149 is a transparent thin film made of a tin oxide, an ITO (Indium Tin Oxide), or the like that is formed by sputtering or the like. The insulation layer 150 is a thin film having water repellency, made of parylene (paraxylylene resin), an inorganic material, or the like, which is formed by CVD (Chemical Vapor Deposition) or the like.

The first liquid 145 is a conductive or polarized liquid. As a polarized liquid material, pure water can be used, for example. As a conductive liquid material, an aqueous solution containing salt can be used, for example. As the first liquid 145, it is desirable to select a liquid that stably exists as a liquid in a wide range of temperature. As the first liquid 145 according to this embodiment, a lithium chloride solution (20 wt %) was used.

The second liquid 146 is an insulating or non-polarized liquid. As a non-polarized liquid material, hexane or the like can be used. As an insulating liquid material, a silicone oil or the like can be used. As the second liquid 146 according to this embodiment, a silicone oil as a material having a high refractive index was used for enlarging a difference in refractive index between the first liquid 145 and the second liquid 146.

For the first liquid 145 and the second liquid 146, it is necessary to select immiscible liquid materials. In addition, to provide a stable liquid lens device, it is desirable to set the same specific gravity for the first liquid 145 and the second liquid 146. Further, it is desirable for the first liquid 145 and the second liquid 146 to be liquid materials that are transparent and have a low viscosity because the first liquid 145 and the second liquid 146 are used as variable optical members.

The liquid lens 50 of this embodiment has the lens surface 151 that is formed at an interface between the two liquids, that is, the first liquid 145 and the second liquid 146. The liquid lens device 2140 of this embodiment has two lens surfaces 151. Two liquid lenses 50 each have a linear shape whose longitudinal direction is parallel to a longitudinal direction of the xenon tube 10. The two liquid lenses 50 are arranged on a plane parallel to the surface of the second substrate 142 in a direction orthogonal to a longitudinal direction of the second substrate 142. The lens surface 151 of each of the liquid lenses 50 can be electrically deformed by voltage control using the first electrode 149 and the second electrode 152.

The liquid lens device 2140 structured as described above operates as follows. Hereinafter, the operation will be described with reference to FIGS. 4A and 4B.

Figure 4A:
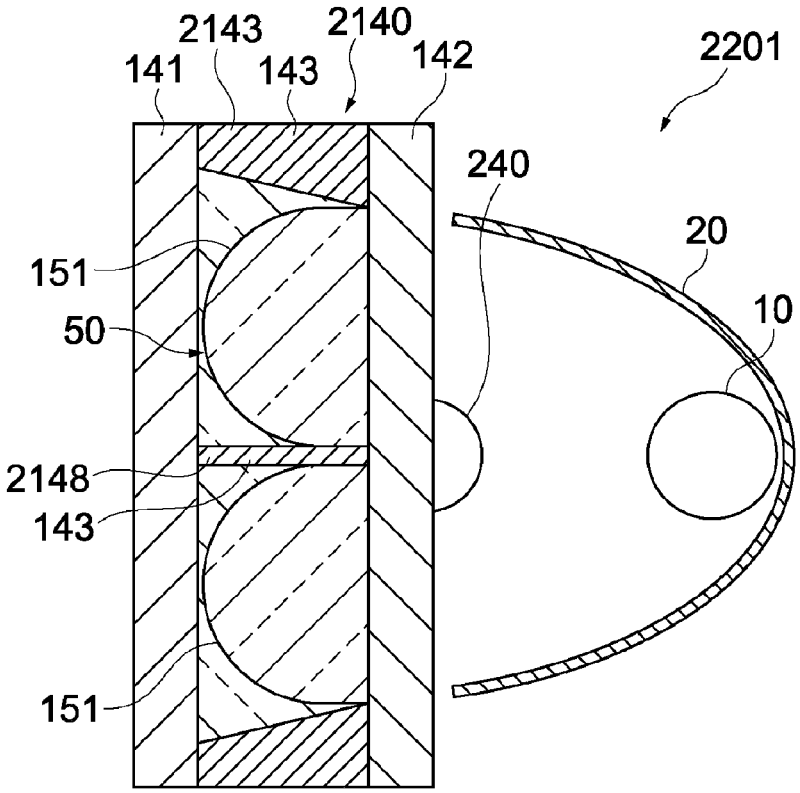
FIGS. 4 are schematic cross-sectional diagrams showing a voltage non-application state and a voltage application state of the flash apparatus of FIG. 3.
Figure 4B:
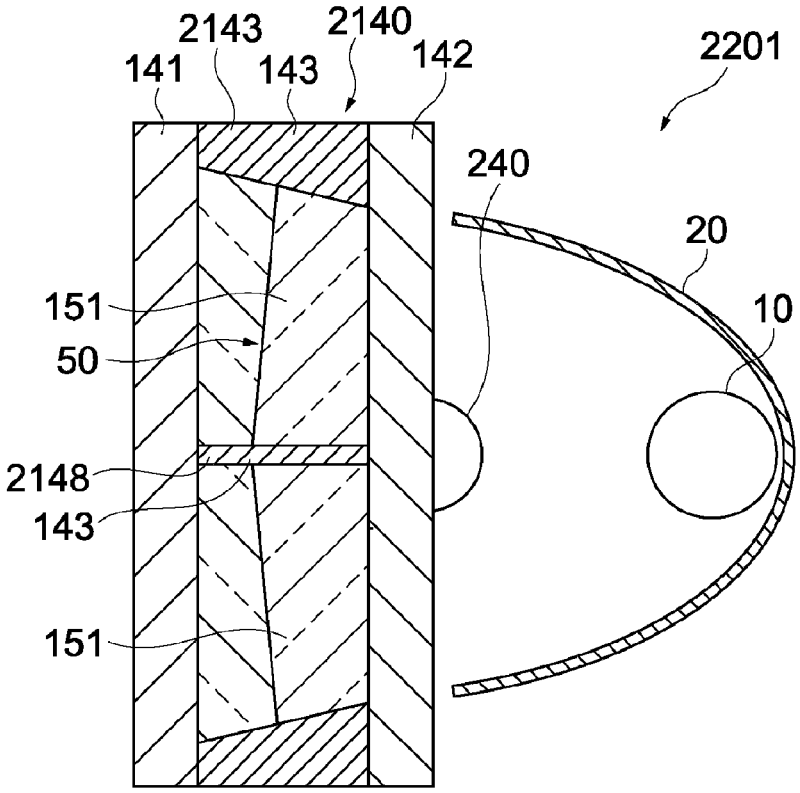

Though FIGS. 4A and 4B are schematic cross-sectional diagrams of a flash apparatus 2201 of a second embodiment to be described later, the operation of the liquid lens device 2140 of the flash apparatus 2201 in a voltage non-application state and a voltage application state is the same as that of the flash apparatus 2001, and accordingly the operation of the flash apparatus 2001 of the first embodiment will be described with reference to FIGS. 4A and 4B. FIG. 4A shows a state where a voltage is not applied to the liquid lens device 2140, and FIG. 4B shows a state where a voltage is applied to the liquid lens device 2140. Further, in FIGS. 4A and 4B, for easy understanding of the figures, the first electrode 149, the second electrode 152, and the insulation layer 150 are not illustrated.

As shown in FIG. 4A, in a voltage non-application state, the first liquid 145 and the second liquid 146 form a two-liquid interface 151 (lens surface) of, for example, a curved shape due to an interfacial tension between the two liquids and between each of the two liquids and the insulation layer 150 (having water repellency). Since an absolute refractive index of the first liquid 145 and that of the second liquid 146 are different from each other, light that enters the liquid lens device 2140 is refracted by the lens effect of the two-liquid interface 151. In such a voltage non-application state, light emitted from the flash apparatus 2001 has wide light orientation characteristics.

When a voltage is applied to the first electrode 149 formed on the cavity substrate 143 from an external power source, charges are accumulated in the first liquid 145 and the first electrode 149. Since the charges are attracted with each other, an interfacial tension between the first liquid 145 and the insulation layer 150 disposed on the first electrode 149 is changed and a shape of the two-liquid interface 151 is changed (electrowetting effect) as shown in FIG. 4B. In such a voltage application state, light emitted from the flash apparatus 2001 has narrow light orientation characteristics, that is, light can be narrowed by the voltage application. In this manner, the lens surface 151 whose light orientation characteristics are changed can be obtained by voltage application.

Since the surrounding wall 2143 that constitutes a part of the cavity substrate 143 is tapered in this embodiment, an optical axis 30 of the lens surface 151 of the liquid lens 50 is positioned so as to extend outwardly and obliquely with respect to the optical axis 11 of the light source 10 in the voltage non-application state. As a result, light that passes through the liquid lens device 2140 has light orientation characteristics with a wide light emission range, as compared to a case using a liquid lens device in which the surrounding wall 2143 is not tapered. It should be noted that the optical axis 11 of the light source 10 is vertical to the first substrate 141 and the second substrate 142 of the liquid lens device 2140.

(Second Embodiment)

Next, a second embodiment will be described.

Hereinafter, in the second embodiment, the same components as those of the first embodiment are denoted by similar reference symbols and descriptions thereof are simplified or omitted. Differences between the first and second embodiments will be mainly described.

Figure 3:
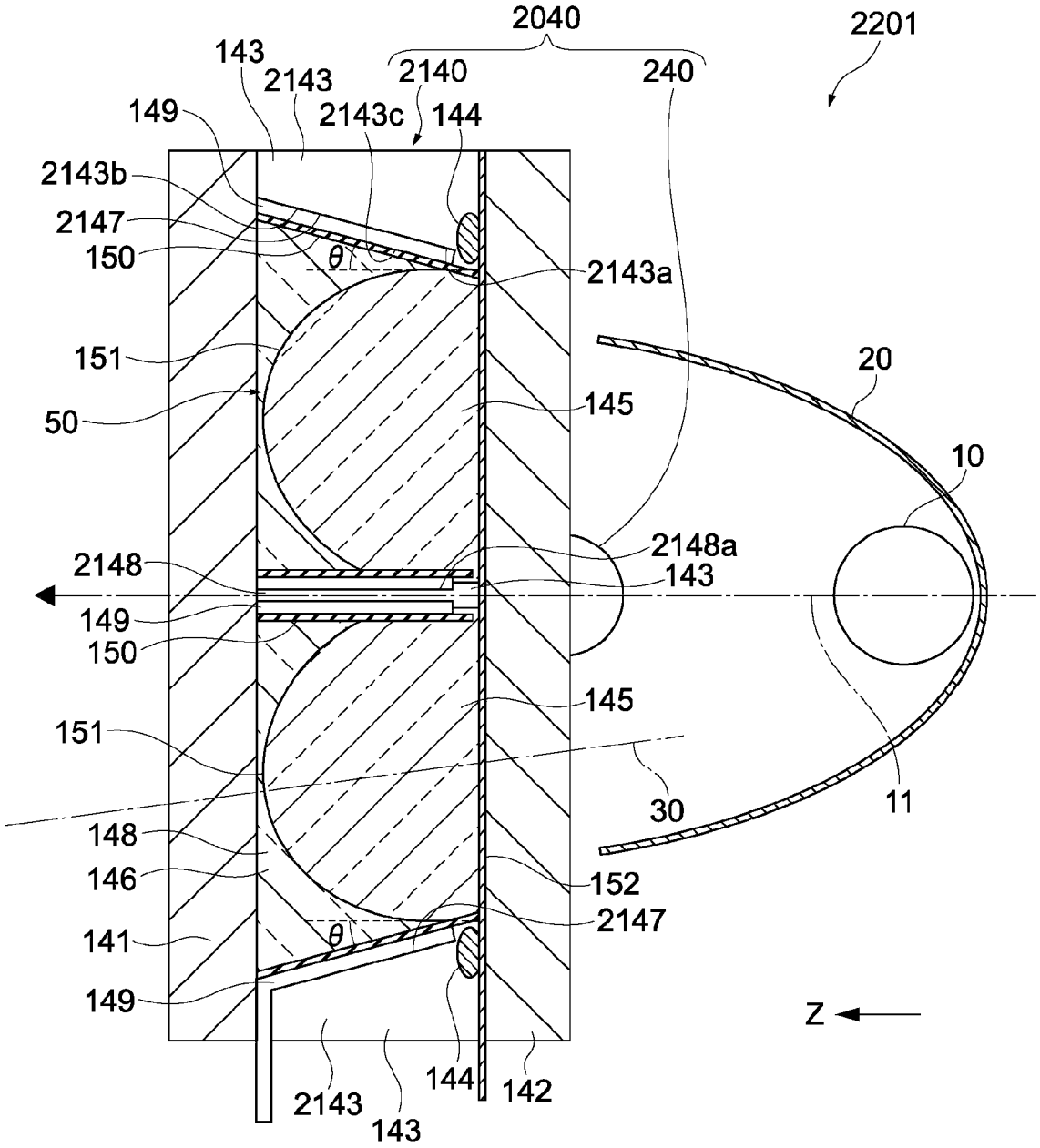
FIG. 3 is a schematic cross-sectional diagram of a flash apparatus according to a second embodiment.

FIG. 3 is a cross-sectional diagram of the flash apparatus 2201 according to this embodiment.

In this embodiment, a cylindrical lens 240 is provided between the xenon tube 10 and the liquid lens device 2140, in addition to the structure of the first embodiment.

The flash apparatus 2201 in this embodiment includes the light source (xenon tube) 10, the reflector 20 as a reflector plate, and a lens device 2040.

The lens device 2040 includes the liquid lens device 2140 and the cylindrical lens 240 as a first optical member.

The cylindrical lens 240 as a convex lens has a linear shape and is disposed such that a longitudinal direction thereof is parallel to a longitudinal direction of each of the xenon tube 10 and the lens surface 151. The cylindrical lens 240 is formed of a transparent organic member of polymethyl methacrylate (PMMA), for example, and has a positive focal length. The cylindrical lens 240 is fixed on a surface of the second substrate 142 on the opposite side of the liquid chamber 148 side at a position corresponding to an interface between two adjacent lens surfaces 151. In other words, the cylindrical lens 240 is disposed at a position corresponding to the partition wall 2148 of the cavity substrate 143 that partitions the liquid chamber 148 into a plurality of regions. The cylindrical lens 240 is disposed between the xenon tube 10 and the liquid lens device 2140. The xenon tube 10 and the cylindrical lens 240 are disposed so as to correspond to an interface between the two lens surfaces 151.

The cylindrical lens 240 desirably has a diameter that is substantially the same as or smaller than a diameter of the xenon tube 10 in cross section. With this structure, light that is emitted from the xenon tube 10 and is not reflected by the reflector 20, which is not parallel to parallel light, is emitted as parallel light after passing though the cylindrical lens 240 to thereby enter the liquid lens device 2140. For example, if the diameter of the cylindrical lens 240 in cross section is larger than that of the xenon tube 10, the light that has been reflected by the reflector 20 to be changed into parallel light passes through the cylindrical lens 240 and then becomes oblique light with respect to parallel light, with the result that desired optical characteristics are difficult to be obtained. The cylindrical lens 240 is disposed so as to correspond to an optical axis 11 of the xenon tube 10.

By providing the cylindrical lens 240 as described above, out of light that is emitted from the xenon tube 10 and passes through the lens device 2040, an amount of the light having an emission angle of around 0 degrees can be sufficiently ensured. Specifically, since the light that is emitted from the xenon tube 10 and enters the second substrate 142 includes light that is not reflected by the reflector 20 and is not parallel to parallel light, a light amount of light in the vicinity of the optical axis 11 parallel to a z axis vertical to a surface of the second substrate 142 is reduced. Accordingly, in a case where the cylindrical lens 240 is not provided, an amount of light that enters a portion in the vicinity of the interface between the two lens surfaces 151 disposed along the optical axis 11 of the xenon tube 10 is reduced, and an amount of light having an emission angle of around 0 degrees out of the light that has passed through the liquid lens device 2140 is reduced. On the other hand, since the lens device 2040 in this embodiment is provided with the cylindrical lens 240, the light that is emitted from the xenon tube 10 and is not reflected by the reflector 20, which is not parallel to parallel light, is changed into parallel light by the cylindrical lens 240. As a result, an amount of the light emitted from the xenon tube 10 in the vicinity of the optical axis 11 can be sufficiently ensured, with the result that desired light orientation characteristics can be obtained.

By providing the cylindrical lens 240 as described above, even with a single xenon tube 10, it is possible to obtain optical characteristics that are substantially equal to those obtained in a case where two xenon tubes 10 are provided so as to correspond to two liquid lenses 50.

The liquid lens device 2140 structured as described above operates as follows. Hereinafter, the operation will be described with reference to FIGS. 4 and 5.

FIGS. 4A and 4B are schematic cross-sectional diagrams of the flash apparatus 2201 in this embodiment. FIG. 4A shows a state where a voltage is not applied to the liquid lens device 2140, and FIG. 4B shows a state where a voltage is applied to the liquid lens device 2140. Further, in FIGS. 4A and 4B, for easy understanding of the figures, the first electrode 149, the second electrode 152, and the insulation layer 150 are not illustrated.

Figure 5:
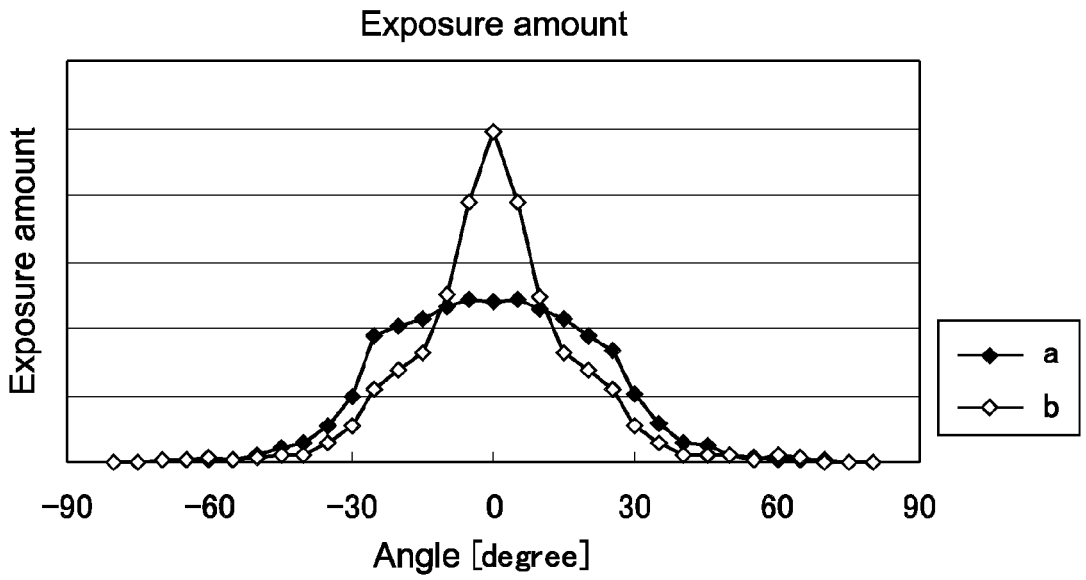
FIG. 5 is a graph showing optical characteristics in the voltage non-application state and the voltage application state of the flash apparatus of FIG. 3.

FIG. 5 shows light orientation characteristics of the flash apparatus 2201 shown in FIGS. 4A and 4B, which are indicated by solid lines "a" and "b", respectively. In FIG. 5, the vertical axis indicates a light amount of emitted light that has been emitted from the xenon tube 10 and has passed through the lens device 2040. The horizontal axis indicates an angle of the emitted light that has been emitted from the xenon tube 10 and has passed through the lens device 2040 with respect to a first substrate 141, that is, an emission angle.

As shown in FIG. 4A, in a voltage non-application state, the first liquid 145 and the second liquid 146 form a two-liquid interface 151 (lens surface) of, for example, a curved shape due to an interfacial tension between the two liquids and between each of the two liquids and the insulation layer 150 (having water repellency). Since an absolute refractive index of the first liquid 145 and that of the second liquid 146 are different from each other, light that enters the liquid lens device 2140 is refracted by the lens effect of the two-liquid interface 151 of the liquid lens 50. In such a voltage non-application state, light emitted from the flash apparatus 2201 has wide light orientation characteristics as indicated by the solid line "a" of FIG. 5.

When a voltage is applied to the first electrode 149 formed on the cavity substrate 143 from an external power source, charges are accumulated in the first liquid 145 and the first electrode 149. Since the charges are attracted with each other, an interfacial tension between the first liquid 145 and the insulation layer 150 disposed on the first electrode 149 is changed and a shape of the two-liquid interface 151 is changed (electrowetting effect) as shown in FIG. 4B. In such a voltage application state, light emitted from the flash apparatus 2201 has narrow light orientation characteristics, that is, light can be narrowed by the voltage application, as indicated by the solid line "b" of FIG. 5. In this manner, the lens surface 151 whose light orientation characteristics are changed can be obtained by voltage application.

Since the surrounding wall 2143 that constitutes a part of the cavity substrate 143 is tapered in this embodiment as well, an optical axis 30 of the lens surface 151 of the liquid lens 50 is positioned so as to extend outwardly and obliquely with respect to the optical axis 11 of the light source 10 in the voltage non-application state. As a result, light that passes through the liquid lens device 2140 has light orientation characteristics with a wide light emission range, as compared to a case of using a liquid lens device in which the surrounding wall 2143 is not tapered.

(Third Embodiment)

Next, a third embodiment will be described.

Hereinafter, in the third embodiment, the same components as those of the second embodiment are denoted by similar reference symbols and descriptions thereof are simplified or omitted. Differences between the second and third embodiments will be mainly described.

Figure 6:
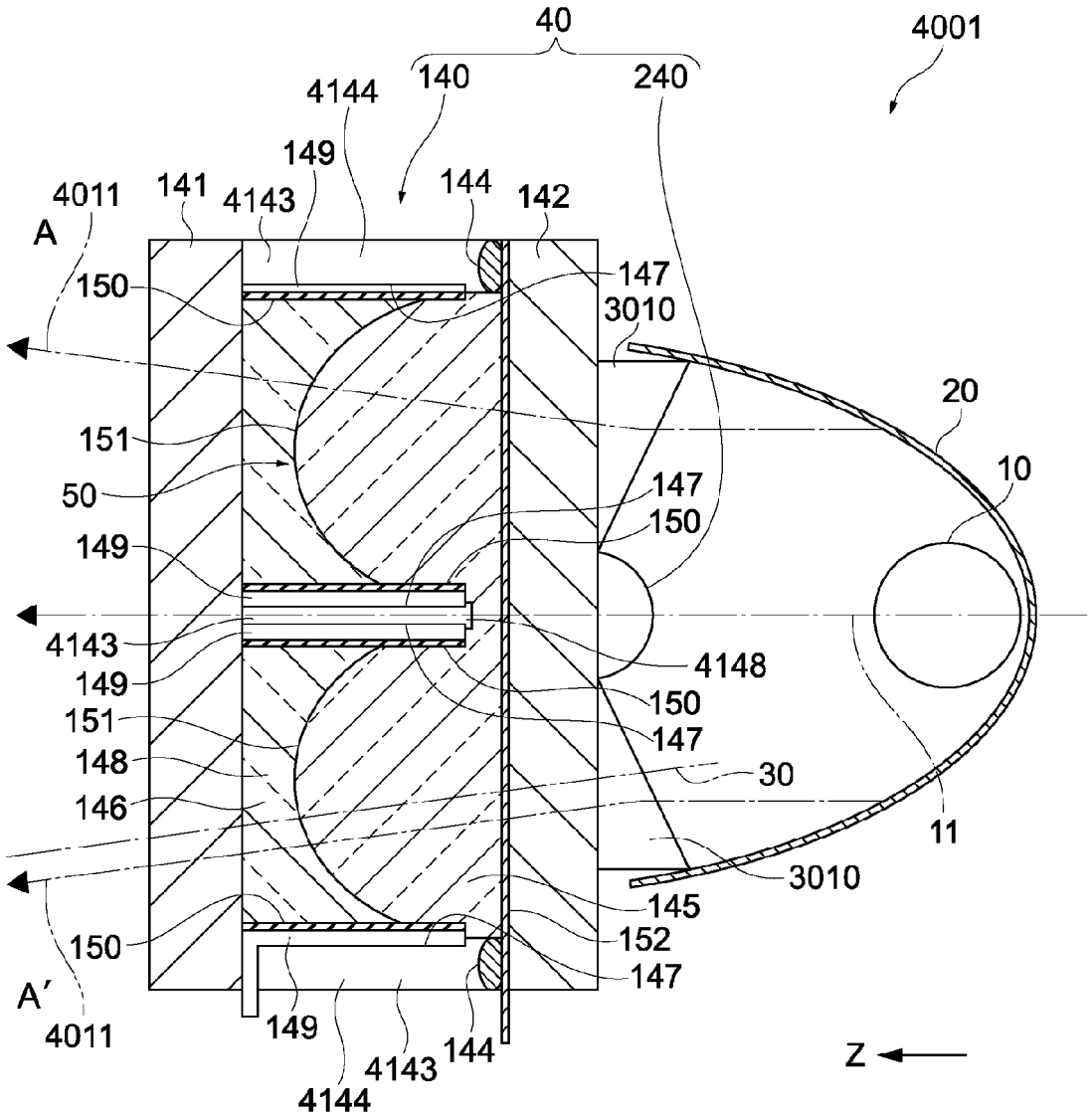
FIG. 6 is a schematic cross-sectional diagram of a flash apparatus according to a third embodiment.

FIG. 6 is a schematic cross-sectional diagram of a flash apparatus 4001 according to this embodiment.

This embodiment is different from the second embodiment in a shape of a cavity substrate 4143, and in that prisms 3010 are provided on both sides of the cylindrical lens 240. In this embodiment, an emission range of light emitted from the flash apparatus 4001 is widened by not providing a tapered inner side surface of a surrounding wall 4144 constituting the cavity substrate 4143 but providing the prisms 3010.

The flash apparatus 4001 in this embodiment includes the light source 10, the reflector 20 as a reflector plate, a lens device 40, and the prisms 3010 as a second optical member.

The lens device 40 includes a liquid lens device 140 and the cylindrical lens 240 as the first optical member.

The liquid lens device 140 includes the first substrate 141, the second substrate 142, the cavity substrate 4143 as a third substrate, and the sealing member 144. The liquid lens 50 constituted of the first liquid 145 and the second liquid 146 is accommodated in a space defined by the above members in the liquid lens device 140.

The cavity substrate 4143 is constituted of the surrounding wall 4144 and a partition wall 4148, and accordingly two through-holes 147 are formed by the surrounding wall 4144 and the partition wall 4148. The partition wall 4148 partitions the liquid chamber 148 surrounded by the surrounding wall 4144 into a plurality of regions, e.g., two regions in this embodiment. An inner side surface of the surrounding wall 4144 and the partition wall 4148 are not tapered, and are vertical to the first substrate 141 and the second substrate 142. Further, the partition wall 4148 is disposed along an optical axis of the light source 10 (parallel to z axis in FIG. 6). The first electrode 149 is formed on a surface of the cavity substrate 4143 on the liquid chamber 148 side, and the insulation layer 150 is formed on an upper surface of the first electrode 149. The first electrode 149 is connected to an external power source (not shown).

The liquid lens device 140 is obtained by laminating the first substrate 141, the cavity substrate 4143, and the second substrate 142 in the stated order. A space defined by the through-holes 147 formed on the cavity substrate 4143, the first substrate 141, and the second substrate 142 becomes the liquid chamber 148. The first liquid 145 and the second liquid 146 are accommodated in the liquid chamber 148.

The prisms 3010 as a second optical member are disposed one by one at both sides of the cylindrical lens 240 on a surface of the second substrate 142 on the opposite side of the liquid chamber 148 side. The prisms 3010 are disposed between the xenon tube 10 and the liquid lens device 140. The prisms 3010 convert the optical axis 30 of light that is emitted from the xenon tube 10 and enters the liquid lens device 140 being in contact with the surrounding wall 4144 so that the optical axis 30 extends outwardly and obliquely with respect to the optical axis 11 of the light from the xenon tube 10. As a result, the parallel light obtained by being emitted from the xenon tube 10 and reflected by the reflector 20 is converted by the prisms 3010 in a direction along the optical axis 30 as indicated by an arrow 4011, and then enters the liquid lens device 140.

As described above, though optical characteristics with a wide light emission range are obtained by providing a tapered surrounding wall of the cavity substrate in the first and second embodiments, optical characteristics with a wide light emission range can also be obtained by providing prisms as in the third embodiment.

(Fourth Embodiment)

Next, a fourth embodiment will be described.

Hereinafter, in the fourth embodiment, the same components as those of the second embodiment are denoted by similar reference symbols and descriptions thereof are simplified or omitted. Differences between the second and fourth embodiments will be mainly described.

Figure 7:
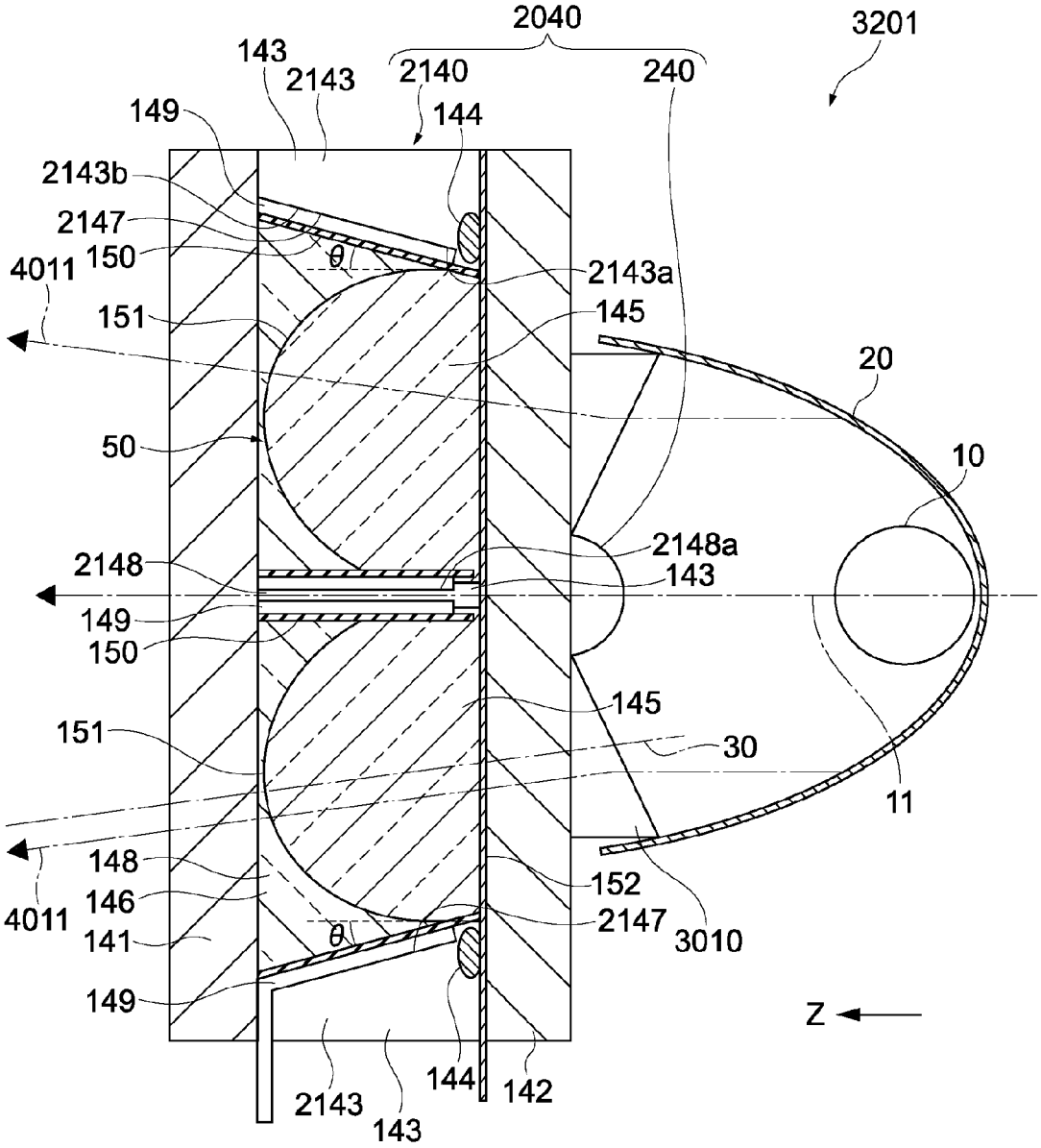
FIG. 7 is a schematic cross-sectional diagram of a flash apparatus according to a fourth embodiment.

FIG. 7 is a cross-sectional diagram of a flash apparatus 3201 according to this embodiment.

This embodiment is different from the second embodiment in that prisms 3010 are provided one by one on both sides of the cylindrical lens 240. Further, this embodiment is different from the third embodiment in that a surrounding wall of a cavity substrate is tapered. Specifically, in the fourth embodiment, obtained is a flash apparatus having optical characteristics with a wider light emission range by providing a tapered surrounding wall of a cavity substrate and further providing prisms.

The flash apparatus 3201 in this embodiment includes the light source 10, the reflector 20 as a reflector plate, the lens device 2040, and the prisms 3010 as a second optical member.

The lens device 2040 includes the liquid lens device 2140 and the cylindrical lens 240 as a first optical member.

The liquid lens device 2140 includes the first substrate 141, the second substrate 142, the cavity substrate 143 as a third substrate, and the sealing member 144. The liquid lens 50 constituted of the first liquid 145 and the second liquid 146 is accommodated in a space defined by the above members in the liquid lens device 2140.

As in the third embodiment, the prisms 3010 as a second optical member are disposed one by one at both sides of the cylindrical lens 240 on the surface of the second substrate 142 on the opposite side of the liquid chamber 148 side. The prisms 3010 are disposed between the xenon tube 10 and the liquid lens device 2140. The prisms 3010 convert the optical axis 30 of light that is emitted from the xenon tube 10 and enters the liquid lens device 2140 being in contact with the surrounding wall 2143 so that the optical axis 30 extends outwardly and obliquely with respect to the optical axis 11 of the light from the xenon tube 10. As a result, the parallel light obtained by being emitted from the xenon tube 10 and reflected by the reflector 20 is converted by the prisms 3010 in a direction along the optical axis 30 as indicated by the arrow 4011, and then enters the liquid lens device 2140.

As described above, optical characteristics with a wider light emission range can be obtained by providing a tapered surrounding wall of a cavity substrate and additionally providing prisms.

(Fifth Embodiment)

Next, a fifth embodiment will be described.

Hereinafter, in the fifth embodiment, the same components as those of the first embodiment are denoted by similar reference symbols and descriptions thereof are simplified or omitted. Differences between the first and fifth embodiments will be mainly described.

Figure 8:
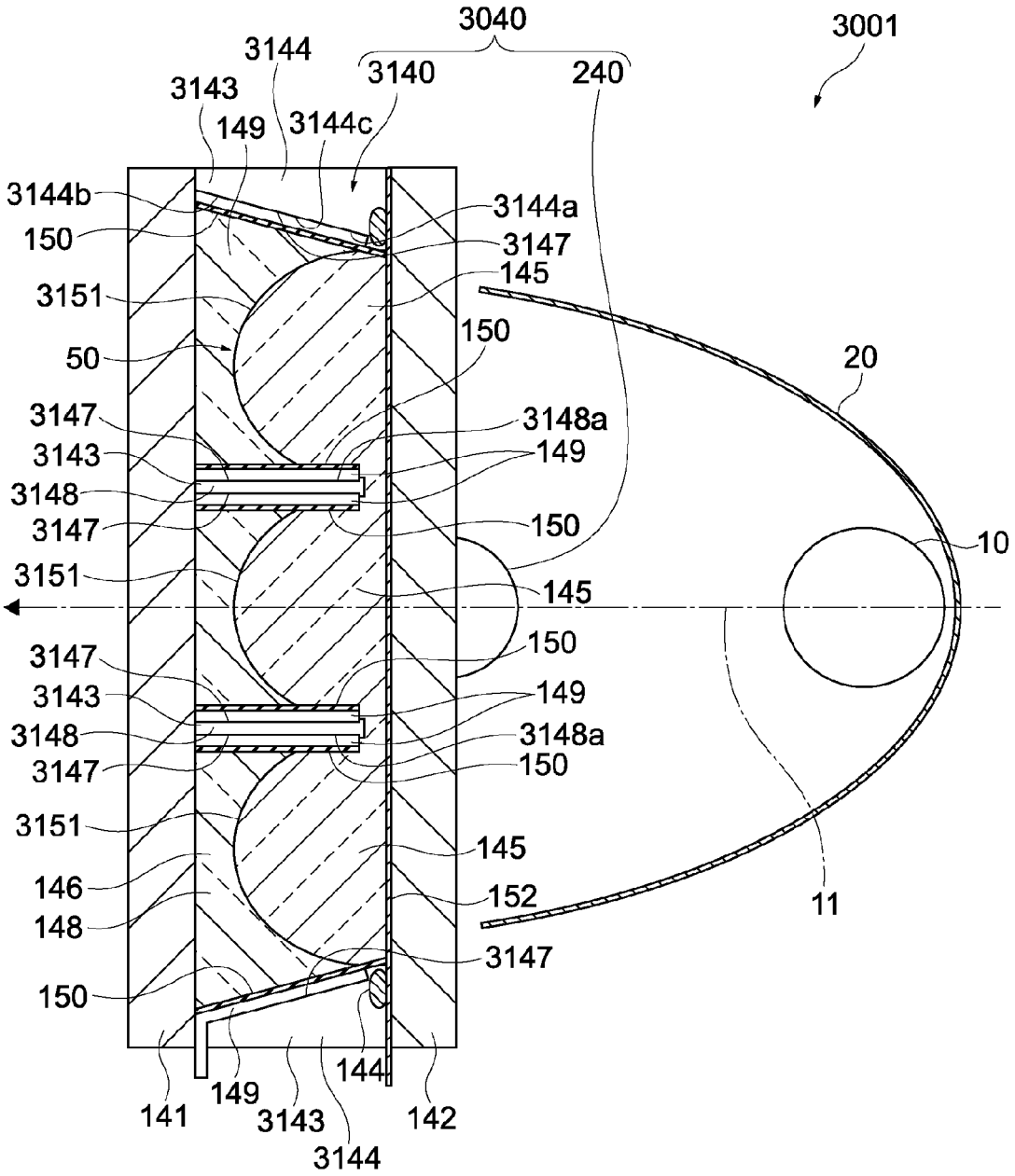
FIG. 8 is a schematic cross-sectional diagram of a flash apparatus according to a fifth embodiment.

FIG. 8 is a cross-sectional diagram of a flash apparatus 3001 according to this embodiment.

This embodiment is different from the first embodiment in a shape of a cavity substrate 3143 and in that two liquid lenses 50 are provided in the first embodiment, whereas three liquid lenses 50 are provided in this embodiment.

The flash apparatus 3001 in this embodiment includes the light source 10, the reflector 20 as a reflector plate, and a lens device 3040.

The lens device 3040 includes a liquid lens device 3140 and the cylindrical lens 240 as a first optical member.

The liquid lens device 3140 includes the first substrate 141, the second substrate 142, the cavity substrate 3143 as a third substrate, and the sealing member 144. The liquid lenses 50 constituted of the first liquid 145 and the second liquid 146 are accommodated in a space defined by the above members in the liquid lens device 3140.

The liquid lens device 3140 is obtained by laminating the first substrate 141, the cavity substrate 3143, and the second substrate 142 in the stated order. A space defined by through-holes 3147 formed on the cavity substrate 3143, the first substrate 141, and the second substrate 142 is to be the liquid chamber 148. The first liquid 145 and the second liquid 146 are accommodated in the liquid chamber 148.

The cavity substrate 3143 is constituted of a surrounding wall 3144 and partition walls 3148, which form three through-holes 3147. The surrounding wall 3144 has a frame shape including a first opening **3144*a* and a second opening 3144*b* that are opposed to each other, and has an inner side surface 3144*c* that is tapered such that an opening area is enlarged toward the second opening 3144*b* from the first opening 3144*a*. The taper has an angle θ of 5 to 10 degrees with respect to a plane vertical to the second substrate 142. The partition walls 3148 partition the liquid chamber 148 surrounded by the surrounding wall 3144 into a plurality of regions, e.g., three regions in this embodiment, with the result that three liquid lenses 50 are formed. A side surface 3148*a* of each partition wall 3148 is not tapered and is vertical to the first substrate 141 and the second substrate 142. A first electrode 149 is formed on a surface of the cavity substrate 3143 on the liquid chamber 148 side, and an insulation layer 150 is formed on an upper surface of the first electrode 149. The first electrode 149** is connected to an external power source (not shown).

By providing the tapered surrounding wall 3144 that constitutes a part of the cavity substrate 3143, an optical axis of a lens surface 3151 of the liquid lens 50 being in contact with the surrounding wall 3144 extends outwardly and obliquely with respect to the optical axis 11 of the light source 10. As a result, light that is emitted from the xenon tube 10 and passes through the liquid lens device 3140 has outwardly-extending light orientation characteristics as compared to a case of using a liquid lens device in which the surrounding wall 3144 is not tapered, with the result that light orientation characteristics with a wide light emission range can be obtained.

Also in a case where the three liquid lenses 50 are provided as described above, the cylindrical lens 240 may be disposed at a position corresponding to the optical axis 11 of the light emitted from the xenon tube 10. With this structure, it is possible to obtain optical characteristics that are substantially equal to those obtained in a case where three xenon tubes 10 in total are provided to correspond to three liquid lenses 50.

(Modified Example)

Figure 9:
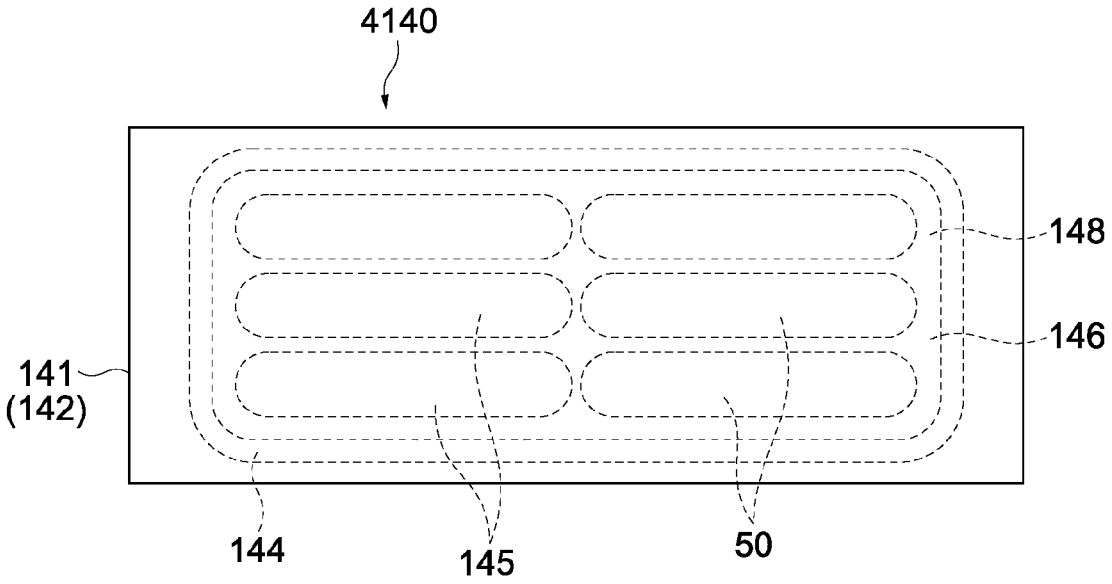
FIG. 9 is a schematic plan view of a liquid lens device according to a modified example.

The liquid lens devices in the above embodiments each have the structure in which two or three liquid lenses are disposed vertically on a plane parallel to the first substrate 141 and the second substrate 142, as shown in FIG. 2. On the other hand, like a liquid lens device 4140 shown in FIG. 9, a liquid lens device may have a structure in which a plurality of liquid lenses are provided also in a lateral direction of the figure. In such a structure, an inner side surface of a surrounding wall disposed between the first substrate 141 and the second substrate 142 only needs to be tapered as described in the above embodiments. FIG. 9 is a schematic plan view of the liquid lens device 4140 and shows the arrangement thereof, in which the same components as those in the above embodiments are denoted by similar reference symbols.

Although the linear xenon tube is used as a light source in the above embodiments, dot-shaped LEDs (light emitting diodes) may be used instead.

Further, in the above embodiments, the partition wall of each of the cavity substrates 143, 3143, and 4143 is formed such that the partitioned regions for the first liquid 145 constituting a plurality of liquid lenses 50 can communicate with each other. However, the partition wall of each of the cavity substrates 143, 3143, and 4143 may be formed such that the partitioned regions for a liquid constituting a plurality of lens surfaces 151 and 3151 do not communicate with each other and accordingly the liquid lenses 50 are separated.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A variable illumination apparatus, comprising:

a first substrate;

a second substrate opposed to the first substrate with a predetermined gap therebetween;

a surrounding wall that is disposed between the first substrate and the second substrate, has a first opening and a second opening that are opposed to each other, and has an inner side surface that is tapered such that an opening area is enlarged toward the second opening from the first opening;

a partition wall to partition a liquid chamber formed by being surrounded by the first substrate, the second substrate, and the surrounding wall into a plurality of regions, the partition wall being vertical to the first substrate and the second substrate;

at least one liquid lens having a lens surface that is formed at an interface between two liquids and is electrically deformable, the two liquids being accommodated in each of the plurality of regions and each having a different refractive index; and a light source to irradiate light to the at least one liquid lens from the first opening side.

2. The variable illumination apparatus according to claim 1, wherein each of the light source and the at least one liquid lens has a linear shape, a longitudinal direction of the light source and that of the at least one liquid lens being parallel to each other.

3. The variable illumination apparatus according to claim 2, further comprising:

a reflector plate to accommodate the light source, and reflect light emitted from the light source and cause the light to enter the liquid lenses as parallel light; and a cylindrical lens that is disposed between the light source and the liquid lenses at a position corresponding to a gap between the adjacent liquid lenses, and emits, as parallel light, the light emitted from the light source but excluding light parallel to the parallel light.

4. The variable illumination apparatus according to claim 3, wherein the at least one liquid lens includes two liquid lenses, wherein the number of light source provided is one, and wherein the light source is disposed at a position corresponding to the interface between the two liquid lenses.

5. The variable illumination apparatus according to claim 4, further comprising:

an optical member that is disposed between the light source and the liquid lenses and converts an optical axis of the light that enters the liquid lenses so that the optical axis extends outwardly and obliquely with respect to an optical axis of the light emitted from the light source.

6. A variable illumination apparatus, comprising:

a first substrate;

a second substrate opposed to the first substrate with a predetermined gap therebetween;

a third substrate disposed between the first substrate and the second substrate to form a liquid chamber;

a liquid lens having a plurality of lens surfaces that are formed at an interface between two liquids and are electrically deformable, the two liquids being accommodated in the liquid chamber and each having a different refractive index;

a light source to irradiate light to the liquid lens; and an optical member that is disposed between the light source and the liquid lens and converts an optical axis of light that enters the liquid lens so that the optical axis extends outwardly and obliquely with respect to an optical axis of light emitted from the light source.

* * * * *